US009812806B2

(12) United States Patent
Uezono

(10) Patent No.: US 9,812,806 B2
(45) Date of Patent: Nov. 7, 2017

(54) TERMINAL FITTING AND CONNECTOR

(71) Applicant: Sumitomo Wiring Systems, Ltd., Yokkaichi, Mie (JP)

(72) Inventor: Katsuya Uezono, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/356,717

(22) Filed: Nov. 21, 2016

(65) Prior Publication Data

US 2017/0170593 A1 Jun. 15, 2017

(30) Foreign Application Priority Data

Dec. 11, 2015 (JP) ..... 2015-241914

(51) Int. Cl.
*H01R 13/40* (2006.01)
*H01R 13/428* (2006.01)
*H01R 4/18* (2006.01)

(52) U.S. Cl.
CPC ..... *H01R 13/428* (2013.01); *H01R 4/185* (2013.01)

(58) Field of Classification Search
CPC . H01R 13/4223; H01R 13/115; H01R 13/111; H01R 13/113; H01R 13/04
USPC ..... 439/595, 849–852, 884
See application file for complete search history.

(56) References Cited

U.S. PATENT DOCUMENTS 6,386,928 B2 * 5/2002 Kitamura ..... H01R 13/113 439/852
6,786,781 B2 * 9/2004 Sai ..... H01R 13/04 439/884
6,790,105 B2 * 9/2004 Fukatsu ..... H01R 13/055 439/884
6,811,436 B2 * 11/2004 Tabata ..... H01R 13/642 439/595
6,981,900 B2 * 1/2006 Sakurai ..... H01R 13/64 439/595
7,048,582 B2 * 5/2006 Tabata ..... H01R 13/113 439/595
7,252,559 B1 * 8/2007 Morello ..... H01R 4/185 439/843
7,278,891 B2 * 10/2007 Cvasa ..... H01R 13/187 439/852
7,351,122 B2 * 4/2008 Suemitsu ..... H01R 13/113 439/852

(Continued)

FOREIGN PATENT DOCUMENTS

JP 2009-252495 10/2009

*Primary Examiner* — Thanh Tam Le
(74) *Attorney, Agent, or Firm* — Gerald E. Hespos; Michael J. Porco; Matthew T. Hespos

(57) ABSTRACT

A terminal fitting includes a wire connecting portion (11) to be connected to an end part of a wire. A terminal body (12) is provided in front of the wire connecting portion (11) and has a square cross-section. A projection (30) projects in a direction intersecting with a front-back direction from the terminal body (12). The projection (30) includes a standing wall portion (35) standing along a side surface of the terminal body (12) from a corner part of the terminal body (12), a front surface of the projection (30) is inclined to gradually reduce a projecting dimension toward front and a rear surface of the projection (30) is open in the front-back direction.

11 Claims, 11 Drawing Sheets

(56) References Cited

U.S. PATENT DOCUMENTS

| | | | | |
|---|---|---|---|---|
| 7,371,133 | B1 * | 5/2008 | Morello | H01R 13/187<br>439/852 |
| 8,523,619 | B2 * | 9/2013 | Itou | H01R 13/113<br>439/852 |
| 8,827,756 | B2 * | 9/2014 | Mueller | H01R 13/112<br>439/852 |
| 2009/0253314 | A1 | 10/2009 | Shimizu | |

* cited by examiner

TERMINAL FITTING AND CONNECTOR

BACKGROUND

1. Field of the Invention

The invention relates to a terminal fitting and to a connector provided therewith.

2. Description of the Related Art

Japanese Unexamined Patent Publication No. 2009-252495 discloses a terminal fitting that is to be accommodated into a cavity of a connector housing while being connected to an end part of a wire. The terminal fitting includes a wire connecting portion to be connected to the end part of the wire and a terminal body in front of the wire connecting portion and having a substantially square cross-section. A projection is provided on widthwise central part of the terminal body to prevent the terminal fitting from being inserted in a wrong orientation into a cavity. The projection enters a groove formed in the cavity if the terminal fitting is in a correct orientation and contacts the rear end of the connector housing if the terminal fitting is in a wrong orientation. In this way, the terminal fitting is prevented from being inserted into the cavity in a wrong orientation In the above-described configuration, the projection of an improperly oriented terminal fitting may enter a corner part of the cavity if the terminal body is inclined in a lateral direction, and the terminal fitting can be inserted forcibly in the erroneous orientation. Thus, it is desired to further enhance an erroneous insertion preventing force of the terminal fitting.

In recent years, it has been desired to make terminal fittings usable for both waterproof and non-waterproof applications. A terminal fitting for waterproof application is accommodated into a cavity through a through hole of a seal mounted in a rear part of a housing. The projection of the above described terminal fitting may damage the seal when passing through the through hole of the seal. Thus, the above-described terminal fitting is not suitable for use in waterproof applications.

The invention was completed based on the above situation and aims to provide a terminal fitting capable of enhancing an erroneous insertion preventing force of the terminal fitting and enabling use in fluidproof application.

SUMMARY

The invention relates to a terminal fitting with a wire connecting portion to be connected to an end part of a wire. A terminal body is in front of the wire connecting portion and has a tubular box. A projection projects from the terminal body in a direction intersecting with a front-back direction. The projection includes a standing wall standing along a side surface of the terminal body from a corner part of the terminal body. A front surface of the projection is inclined to gradually reduce a projecting dimension toward the front and a rear surface of the projection is open in the front-back direction.

The projection may include a projecting wall adjacent to the standing wall in a width direction of the terminal body. The projecting wall may be at least partly open on the side of the standing wall and may project up to a height of the standing wall. According to this configuration, a height of the projecting wall can be increased as compared to the case where the projecting wall is open on the side of the projecting wall. Thus, the height of the projecting wall can be increased.

The projecting wall may be formed by striking a part of a side wall of the terminal body. Thus, the height of the projecting wall by striking can be increased.

An opening may penetrate through the side wall in a wall thickness direction and at a position behind the projecting wall. According to this configuration, the projecting wall can be formed easily by striking as compared to the case where the projecting wall is formed by striking while the rear end thereof is separated.

An inner wall may cover the opening by being bent inward from the side wall. Thus, external matter cannot enter the opening.

The projection may be closer to one side of the terminal body in a width direction and/or a width of the projection may be larger than half a width of the terminal body.

A projecting side portion may substantially facing the standing wall and may stand obliquely to gradually narrow a width of the projection from the lower end toward the upper or distal end.

The invention also relates to a connector comprising a housing having at least one cavity in which the above-described terminal fitting is inserted.

The cavity may include a body inserting portion having a cross-section substantially in conformity with the outer shape of the terminal body and a projection inserting portion having a cross-section substantially in conformity with the outer shape of the projection.

According to the invention, the rear surface of the projection at least partly is open. Thus, a height of the projection can be increased as compared to the case where the rear surface of the projection is closed (rear end of the projection is connected to the terminal body portion). Further, if the terminal fitting is inclined toward one side in a lateral direction, the standing wall is located in an intermediate part of the cavity in a width direction. If the terminal fitting is inclined toward the other side, the standing wall is located in an intermediate part of the cavity in a height direction. Thus, the projection cannot enter the corner part of the cavity and an improperly oriented terminal fitting cannot be inserted forcibly. In addition, since the front surface of the projection is inclined, a seal will not be damaged when the terminal fitting is passed through a through hole of the seal member. Thus, according to the present invention, it is possible to enhance an erroneous insertion preventing force of the terminal fitting and use the terminal fitting for waterproof application.

These and other features of the invention will become more apparent upon reading of the following detailed description and accompanying drawings. It should be understood that even though embodiments are described separately, single features thereof may be combined to additional embodiments.

DETAILED DESCRIPTION

Figure 1:
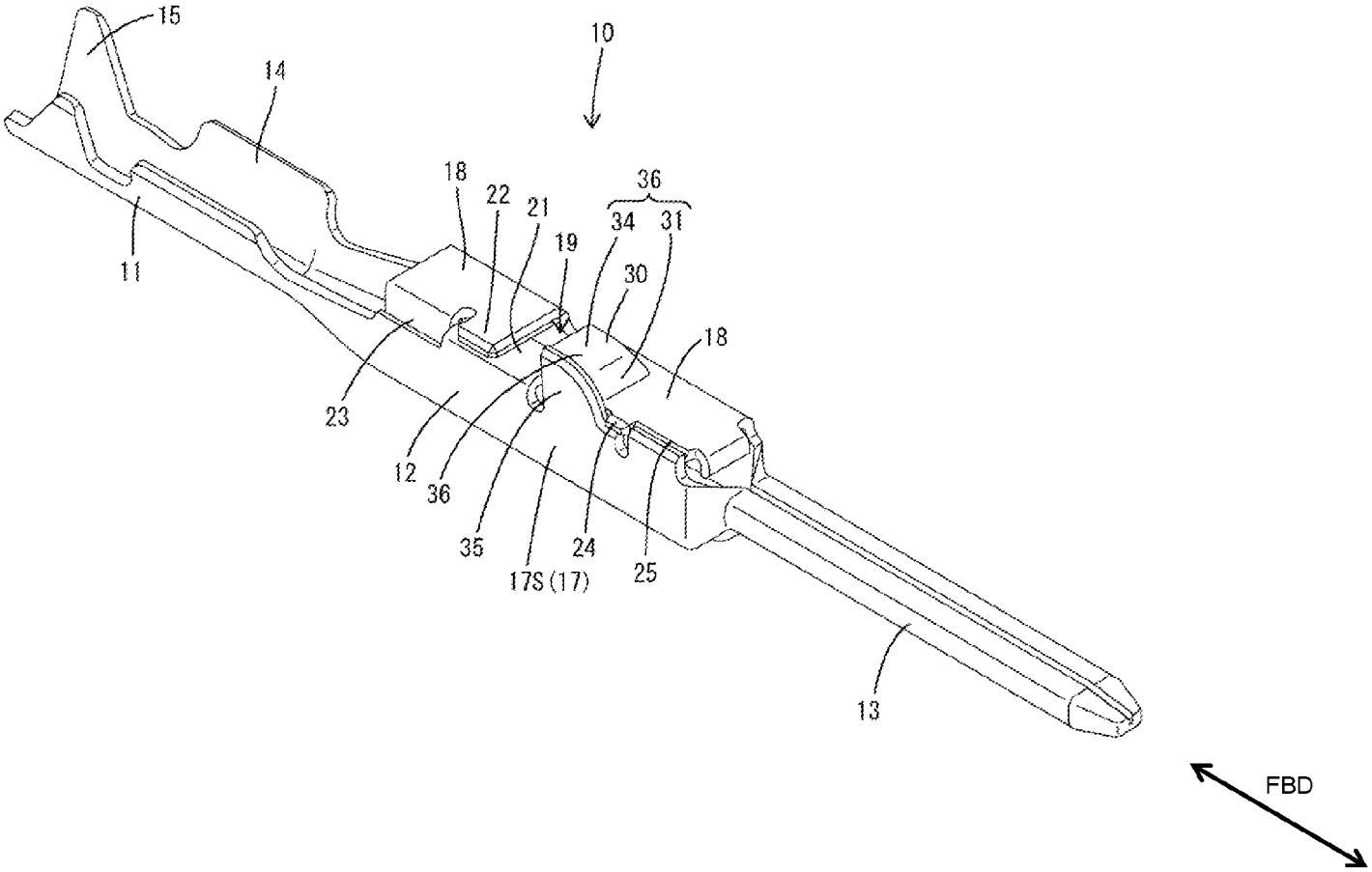
FIG. 1 is a perspective view showing a terminal fitting in an embodiment.
Figure 2:
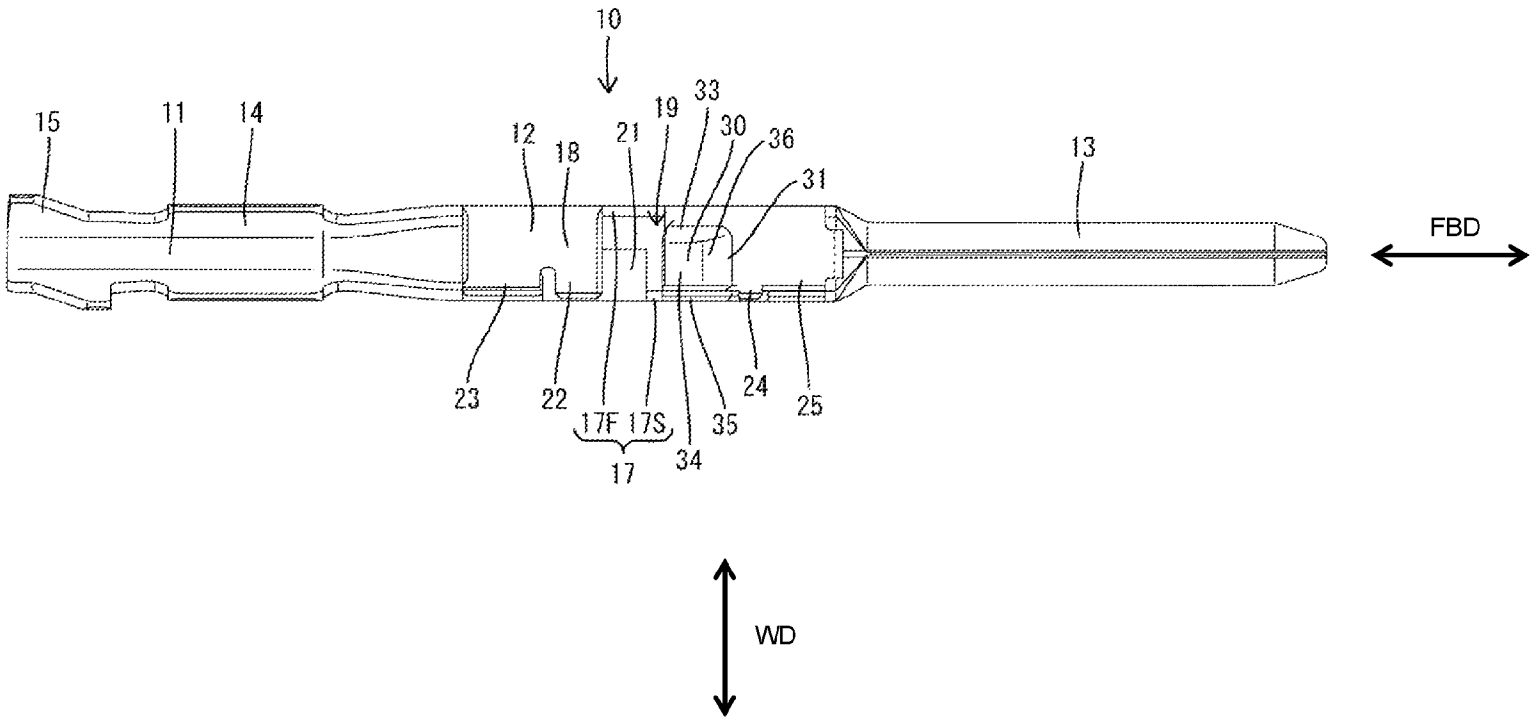
FIG. 2 is a plan view showing the terminal fitting.

One embodiment of the invention is described with reference to FIGS. 1 to 10. A terminal fitting 10 in this embodiment is to be accommodated into a cavity 41 of a connector housing 40 while being connected to an end part of a wire. The terminal fitting 10 is formed by punching out or cutting a conductive metal plate into a predetermined shape and, then, bending the punched-out or cut metal piece into a predetermined shape. In the following description, a right-lower side of FIG. 1 (side to be connected to a mating terminal fitting) is referred to as a front, a left-upper side of FIG. 1 (side to be connected to the wire) is referred to as a rear, an upper side of FIG. 1 (side where a projection 30 to be described later is provided) is referred to as an upper side and a lower side of FIG. 1 is referred to as a lower side.

The terminal fitting 10 is a male terminal fitting including a wire connecting portion 11 to be connected to the end part of the wire, a terminal body 12 in front of the wire connecting portion 11 and a tab 13 projecting forward from the terminal body 12. The tab 13 is in the form of a doubled plate by having left and right edge parts folded and placed above.

The wire connecting portion 11 includes at least one wire barrel 14 to be crimped, bent or folded to a conductor exposed at the end part of the wire and at least one insulation barrel 15 to be crimped to an end part of an insulation coating.

Figure 3:
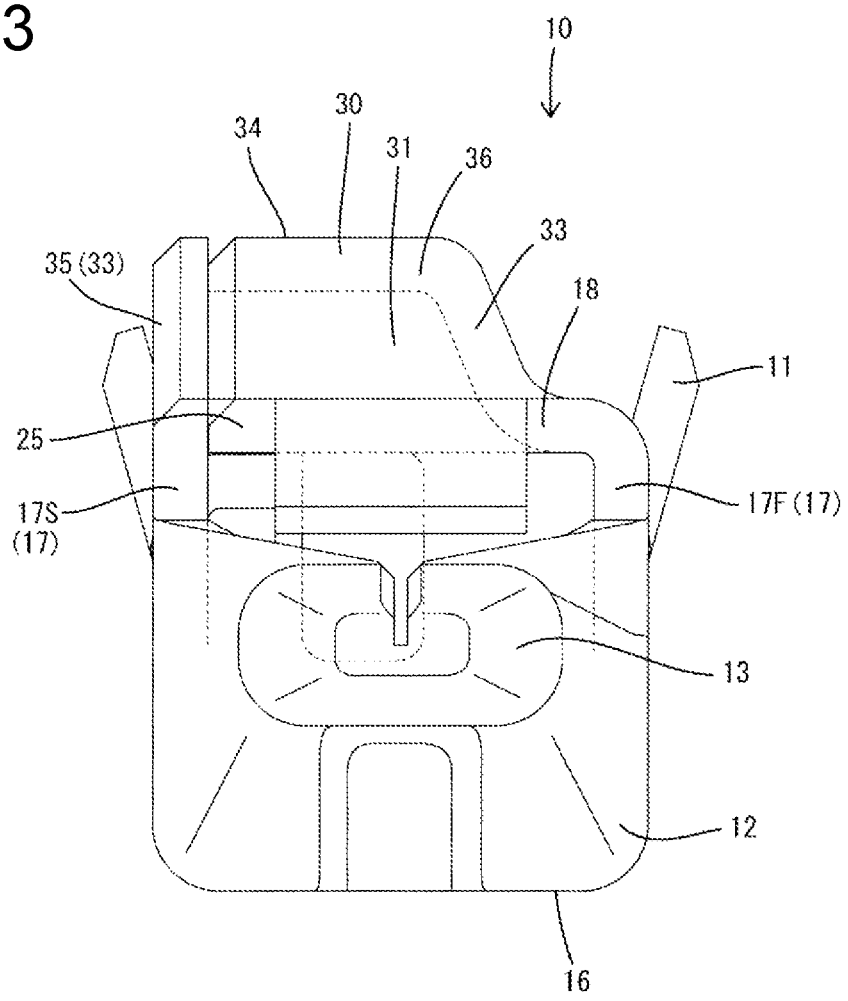
FIG. 3 is a front view showing the terminal fitting.
Figure 4:
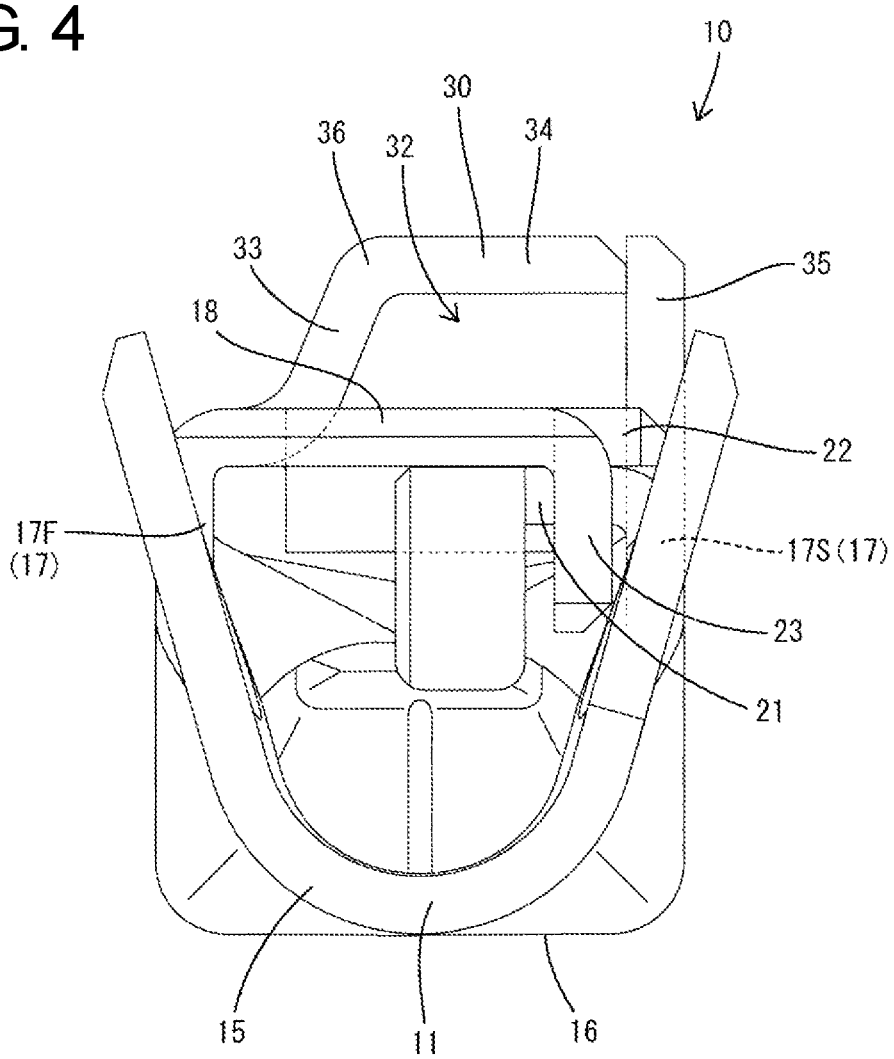
FIG. 4 is a rear view showing the terminal fitting.
Figure 5:
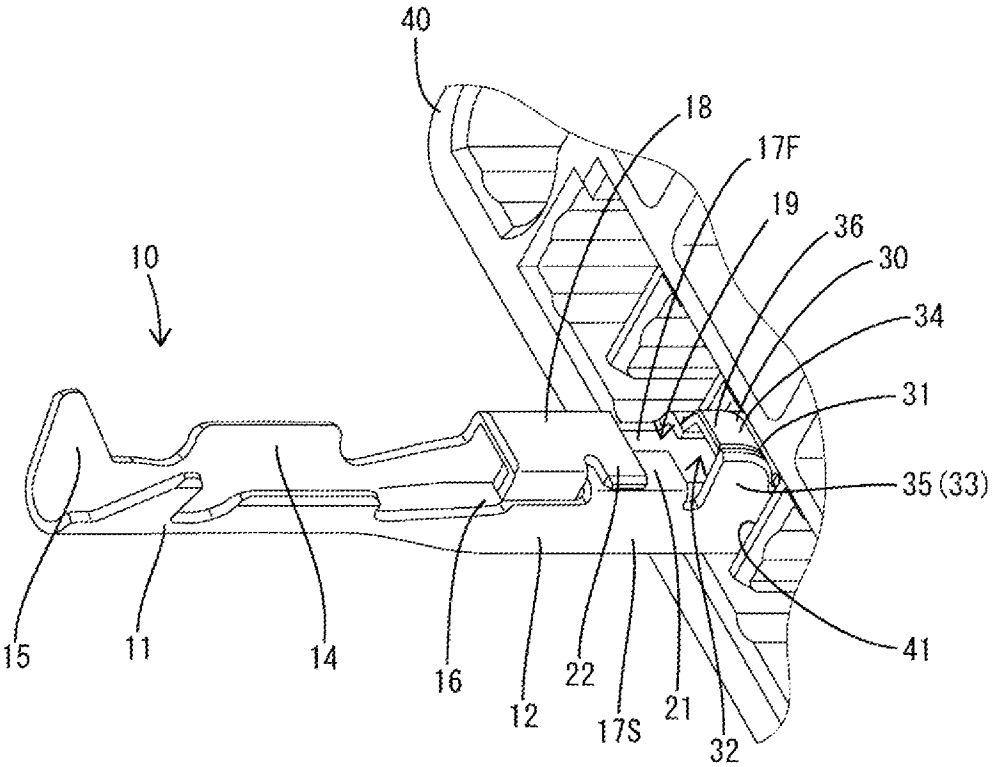
FIG. 5 is a partial enlarged perspective view of a connector showing a state where the terminal fitting is inserted in a correct orientation into a cavity.

As shown in FIGS. 3 and 4, the terminal body 12 has a substantially square cross-section and includes a bottom wall 16, both left and right side walls 17 bent up from both left and right side edges of the bottom wall 16 and standing up, and a ceiling wall 18 arranged between upper end parts of the left and right side walls 17 and vertically facing the bottom wall 16. The ceiling wall 18 is continuous with one side wall (hereinafter, referred to as a first side wall 17F) and bent substantially at a right angle at the upper end of the first side wall 17F.

The terminal fitting 10 includes the projection 30 projecting outward (in a direction intersecting with a front-back direction FBD) from the terminal body portion 12. The projection 30 projects up from the upper surface of the terminal body 12. The projection 30 is provided closer to one end side of the terminal body 12 in a width direction WD. A width of the projection 30 is made larger than substantially half the width of the terminal body 12.

The front surface of the projection 30 is formed into a projecting oblique portion 31 inclined to gradually reduce a projecting dimension toward the front. The projecting oblique portion 31 is provided over the entire width of the projection 30.

On the other hand, the rear surface of the projection 30 is formed into a projecting opening 32 at least partly open in the front-back direction (see FIG. 4). The projecting opening 32 is formed in the entire rear surface of the projection 30 and has a substantially square shape when viewed from behind.

The projection 30 includes two projecting sides 33 standing on the outer surface of the terminal body 12 and a projecting ceiling 34 bridging between upper end parts of the pair of projecting sides 33 (see FIG. 4). The projecting ceiling 34 faces the upper surface of the terminal body 12 substantially in parallel. The projecting opening 32 is formed by being surrounded by the projecting sides 33 and the projecting ceiling 34.

One projecting side 33 defines a standing wall 35 standing along a side surface of the terminal body 12 from a corner part of the terminal body 12. The standing wall 35 is substantially at a right angle to the upper surface of the terminal body 12. As shown in FIG. 1, the standing wall 35 is continuous with a second side wall 17S facing the first side wall 17F of the terminal body 12 and in the form of an upward projecting part of the second side wall 17S. The front surface of the standing wall 35 is gradually inclined down toward the front, thereby configuring the projecting oblique portion 31. The rear surface of the standing wall 35 is vertically standing.

The projecting side 33 facing the standing wall 35 is obliquely standing to gradually narrow a width of the projection 30 (approach the standing wall 35) from the lower end toward the upper end as shown in FIG. 4.

The projection 30 includes a projecting wall 36 separated from the standing wall 35. The projecting wall 36 is formed adjacent to the standing wall 35 in the width direction WD of the terminal body 12. The projecting wall 36 is formed by striking a part of the ceiling wall (side wall) 18 of the terminal body 12.

The rear surface of the projecting wall 36 is open backward, and the side surface thereof on the side of the projecting wall 35 is laterally open and projects up to a height of the standing wall 35. The rear surface of the projecting wall 36 is located entirely in the projecting opening 32 and the side surface thereof is entirely closed by the standing wall 35. A part of the projecting wall 36 facing the standing wall 35 constitutes the projecting side portion 33. Further, a part of the projecting wall 36 connected to an upper end edge part of the standing wall 35 in the width direction WD constitutes the projecting ceiling 34 and the projecting oblique 31 of the projection 30.

The terminal body 12 is formed with a body opening 19 penetrating through the ceiling wall 18 in a wall thickness direction. The body opening 19 is formed adjacent to a side of the ceiling wall 18 behind the projecting wall 36 (see FIG. 2). The body opening 19 has a square shape extending over the entire width of the ceiling wall 18. A dimension of the body opening 19 in the width direction WD is slightly larger than a dimension thereof in the front-back direction.

The terminal body 12 includes an inner wall 21 located inside the body opening 19 to close the body opening 19. The inner wall 21 covers a part of the body opening 19 on the side of the second side wall 17S. The inner wall 21 covers a range slightly wider than a substantially half of the body opening 19 in the width direction WD of the terminal body 12. The inner wall 21 is arranged at a position slightly distant behind the standing wall 35. As shown in FIG. 1, the inner wall 21 has a rectangular shape long in the front-back direction FBD, a front part covers the body opening 19 and a rear part is placed on the inner side (lower side) of the ceiling wall 18.

The inner wall 21 is continuous with the second side wall 17S and bent substantially at a right angle at the upper end of the second side wall 17S. A width of the inner wall 21 is equal to a standing dimension of the standing wall portion 35. In this way, yield can be improved, for example, as compared to the case where the inner wall 21 is not provided and the case where the width of the inner wall 21 and the standing dimension of the standing wall portion 35 are different. This is because the inner wall 21 is formed utilizing a part located behind the standing wall portion 35 in a developed state.

As shown in FIG. 1, a side wall overlapping portion 23 is placed on the inner side of the second side wall 17S at a position behind a part of the ceiling wall 18 that overlaps the inner wall 21. The side wall overlapping portion 23 is formed by bending a part of the ceiling wall 18 down at an end on the side of the second side wall 17S as shown in FIG. 4.

Further, as shown in FIG. 1, a part of the ceiling wall 18 in front of the projecting wall 36 has a first contact portion 24 configured to contact the upper end of the second side wall 17S from above and a second contact portion 25 configured to contact the inner side of the second side wall 17S. The first contact portion 24 contacts a part of the upper end of the second side wall 17S proximate to the standing wall 35. The second contact portion 25 contacts a front end part of the second side wall 17S.

Figure 7:
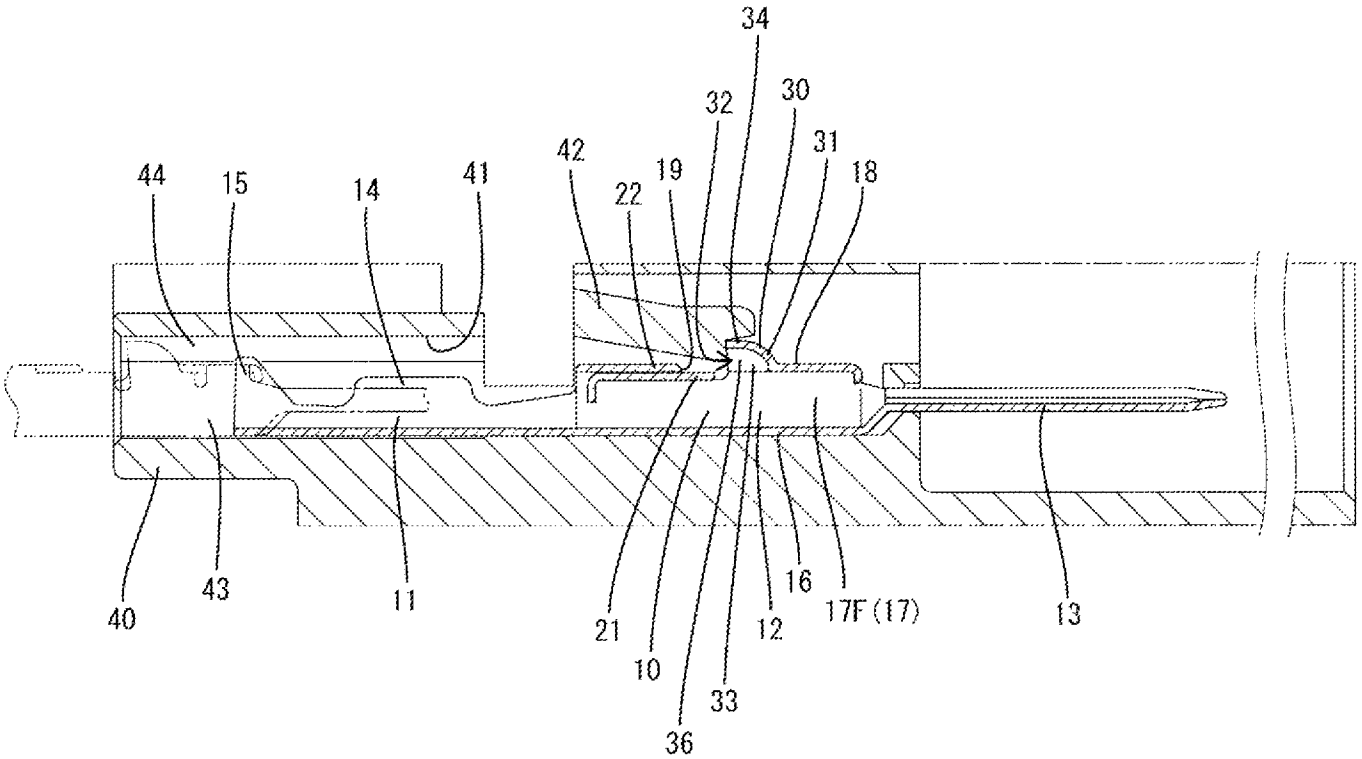
FIG. 7 is a section of the connector showing the state where the terminal fitting is inserted in the correct orientation into the cavity.
Figure 8:
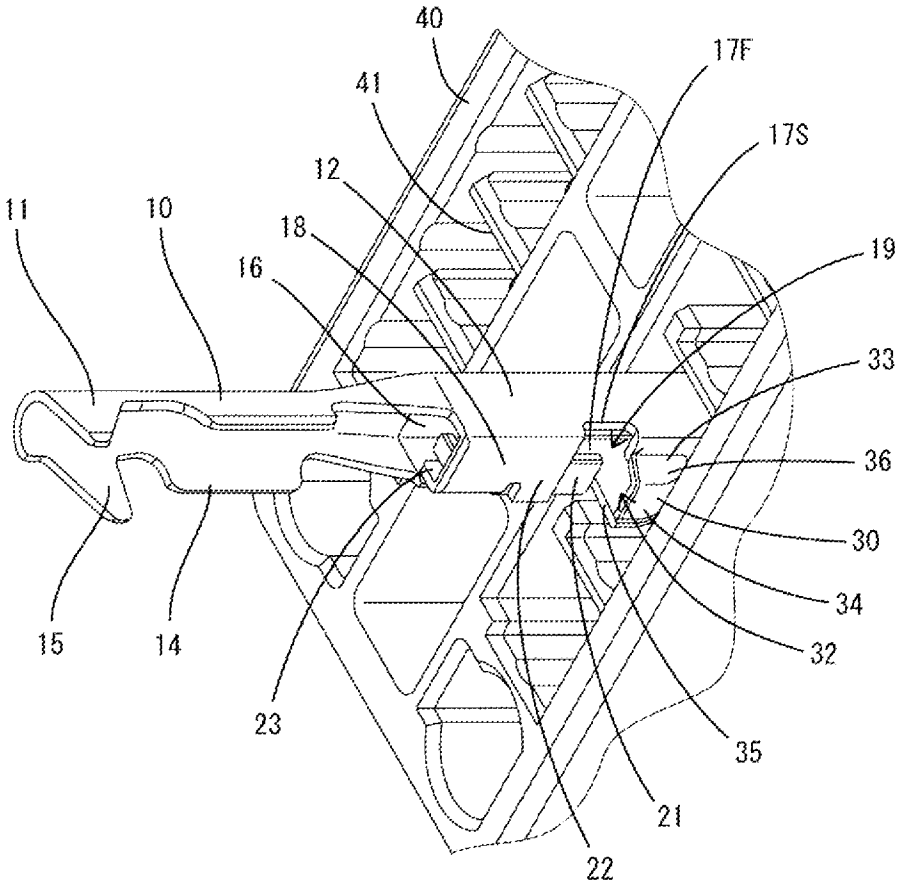
FIG. 8 is a partial enlarged perspective view of the connector showing a state where erroneous insertion of the terminal fitting is prevented.
Figure 9:
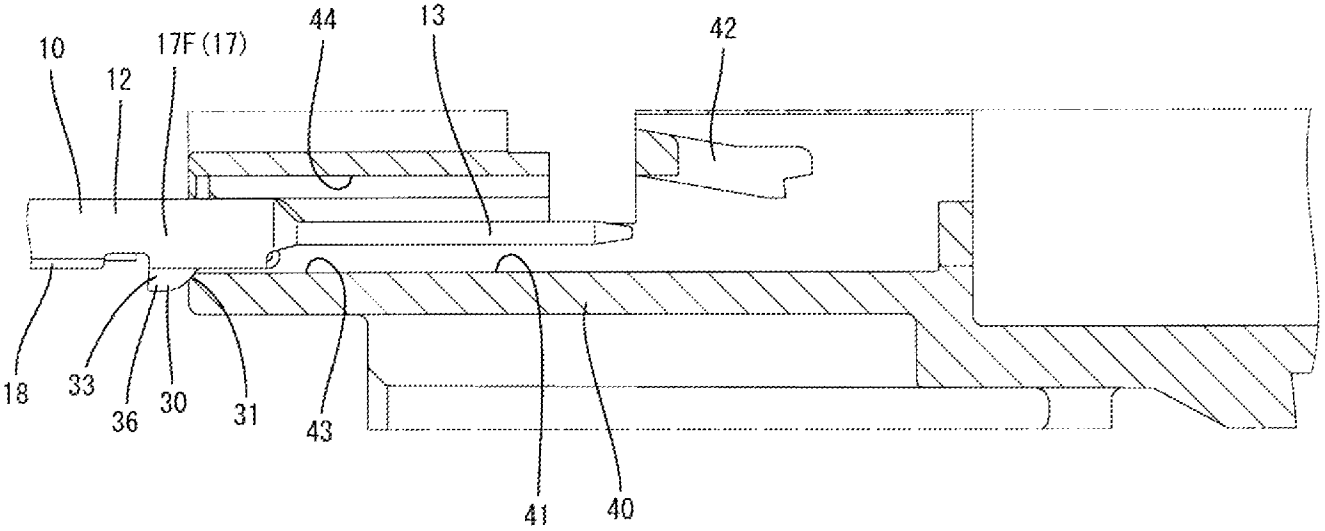
FIG. 9 is a section of the connector showing the state where erroneous insertion of the terminal fitting is prevented.

The connector housing 40 is made e.g. of synthetic resin and cavities 41 are formed side by side in the vertical and lateral directions. As shown in FIG. 7, the terminal fittings 10 are accommodated respectively in the cavities 41 from behind. Each cavity 41 has a locking lance 42 capable of locking and retaining the terminal fitting 10 inserted to a proper position. The locking lance 42 is cantilevered forward in a front part of the cavity 41 and is configured for locking the rear surface of the projection 30 of the terminal fitting 10 from behind.

Figure 6:
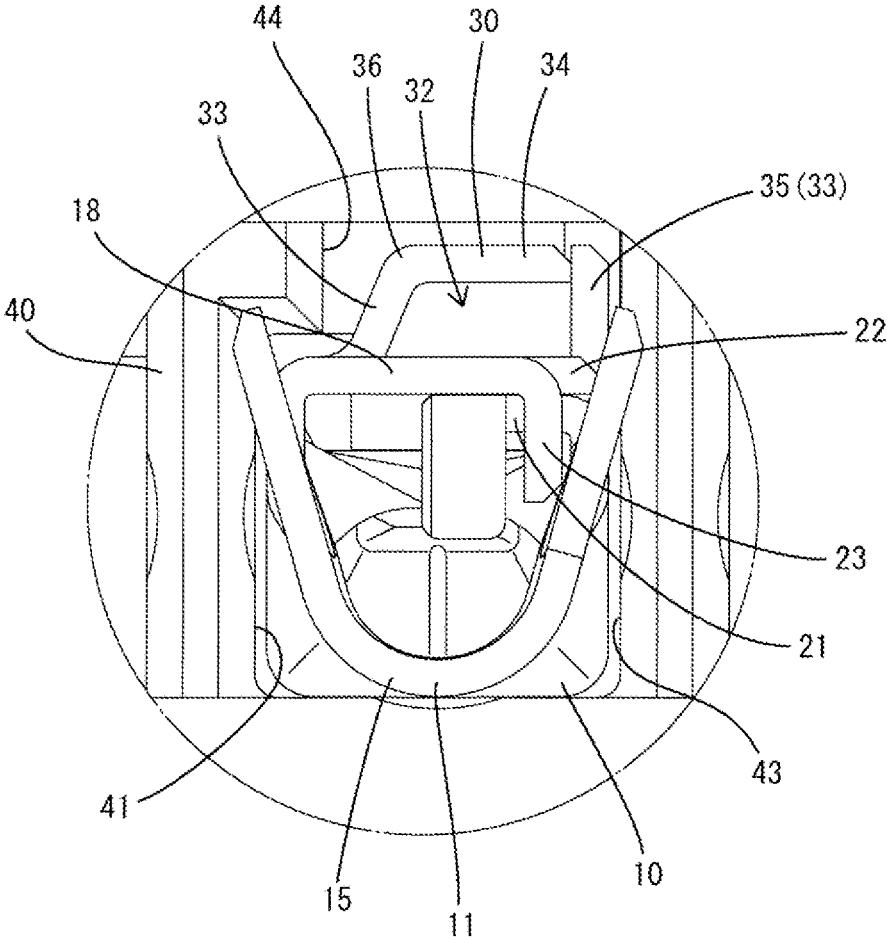
FIG. 6 is a partial enlarged rear view of the connector showing the state where the terminal fitting is inserted in the correct orientation into the cavity.

As shown in FIG. 6, each cavity 4 includes a body inserting portion 43 having a substantially square cross-section in conformity with the outer shape of the terminal body 12, and a projection inserting portion 44 having a substantially square cross-section in conformity with the outer shape of the projection 30. The projection inserting portion 44 is formed above the body inserting portion 43. The projection inserting portion 44 is located closer to one side in a width direction of the body inserting portion 43.

As shown in FIG. 6, the projection 30 is inserted into the projection inserting portion 44 if the terminal fitting 10 is in a correct orientation (in this embodiment, an orientation in which the projection 30 is arranged on an upper side). In this way, the terminal fitting 10 can be inserted fully in the cavity 41, thereby being accommodated at a proper position as shown in FIG. 7.

Figure 10:
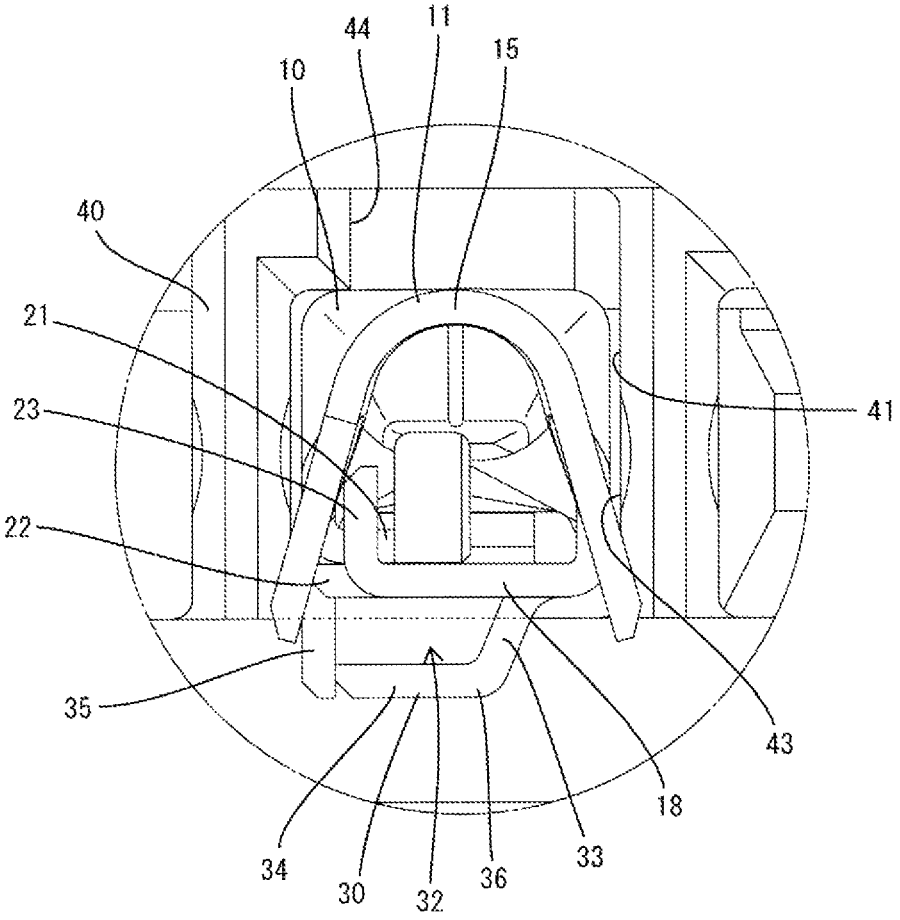
FIG. 10 is a partial enlarged rear view of the connector showing the state where erroneous insertion of the terminal fitting is prevented.

As shown in FIG. 10, if the terminal fitting 10 is in a wrong orientation (in this embodiment, an orientation in which the projection 30 is arranged on a lower side), the projection 30 abuts against the rear end of the connector housing 40. With the terminal fitting 10 of this embodiment, the projection 30 reliably abuts against the rear end of the connector housing 40 even if the terminal body 12 is inclined. Specifically, if the terminal fitting 10 is inclined toward one side in the lateral direction (e.g. in the case of counterclockwise rotation in FIG. 10), the standing wall 35 is located in an intermediate part in a height direction of the cavity 41 (intermediate part of the left side wall). If the terminal fitting 10 is inclined toward the other side (in the case of clockwise rotation in FIG. 10), the standing wall 35 is located in an intermediate part in a width direction of the cavity 41 (intermediate part of the lower side wall). Thus, even if the terminal fitting 10 is inclined, the projection 30 reliably abuts against the rear end of the connector housing 40. Hence, the projection 30 does not forcibly enter a corner part of the cavity 41 and reliably prevents erroneous insertion of the terminal fitting 10. Therefore, the terminal fitting 10 is prevented reliably from being forcibly inserted in a vertically wrong orientation into the cavity 41.

Next, functions and effects of the embodiment configured as described above are described.

The terminal fitting 10 of this embodiment includes the wire connecting portion 11 to be connected to the end part of the wire, the terminal body 12 provided in front of the wire connecting portion 11 and having a substantially square cross-section and the projection 30 standing up from the terminal body 12. The projection 30 includes the standing wall 35 standing along the side surface of the terminal body 12 from the corner part of the terminal body portion 12, the front surface of the projection 30 is inclined to gradually reduce the projecting dimension toward the front and the rear surface of the projection 30 is open in the front-back direction FBD.

According to this configuration, since the rear surface of the projection 30 is open, the height of the projection 30 can be increased as compared to the case where the rear surface of the projection 30 is closed (rear end of the projection 30 is connected to the terminal body 12). Further, if the terminal fitting 10 is inclined toward one side in the lateral direction, the standing wall 35 is located in the intermediate part of the cavity 41 in the width direction WD. If the terminal fitting 10 is inclined toward the other side, the standing wall 35 is located in the intermediate part of the cavity 41 in the height direction. Thus, the projection 30 cannot enter the corner part of the cavity 41 and the terminal fitting 10 cannot be inserted forcibly in an erroneous orientation. In addition, since the front surface of the projection 30 is inclined, a seal will not be damaged when the terminal fitting 10 is passed through a through hole of the seal. Thus, according to the invention, it is possible to enhance a force for preventing erroneous insertion of the terminal fitting 10 and use the terminal fitting 10 for waterproof application.

Further, the projection 30 includes the projecting wall 36 adjacent to the standing wall 35 in the width direction of the terminal body 12, open on the side of the standing wall 35 and projecting to the height of the standing wall 35, and the projecting wall 36 is formed by striking a part of the ceiling wall 18 of the terminal body 12. According to this configuration, a height of the projecting wall 36 by striking can be increased as compared to the case where the projecting wall 36 is not open on the side of the standing wall 35. Thus, the height of the projecting wall 36 can be made sufficiently large also by striking. Specifically, if the projecting wall 36 is not open on the side of the standing wall 35, a limit of a striking height is about 2 to 2.5 times as large as the plate thickness. Since the projecting wall 36 is open on the side of the standing wall 35, a striking height that is three times as large as the plate thickness can be realized. Thus, a locking force with the locking lance 42 and a force for preventing erroneous insertion can be made sufficiently large. Further, even if the height of the projection 30 is increased in this way, the seal will not be damaged when the terminal fitting 10 is passed through the through hole of the seal since the front surface of the projection 30 is inclined.

Further, the body opening 19 penetrating through the ceiling wall 18 in the wall thickness direction is formed on the side of the ceiling wall 18 behind the projecting wall 36.

According to this configuration, the projecting wall 36 easily can be formed by striking as compared to the case where the projecting wall 36 is formed by striking while the rear end thereof is separated.

Further, the terminal body 12 includes the inner wall 21 located inside the body opening 19 to close the body opening 19. According to this configuration, the entrance of external matters (e.g. tab portion 13 of another terminal fitting 10 and the like) into the body opening 19 can be prevented.

The invention is not limited to the above described embodiment. For example, the following embodiments also are in the scope of the invention.

Figure 11:
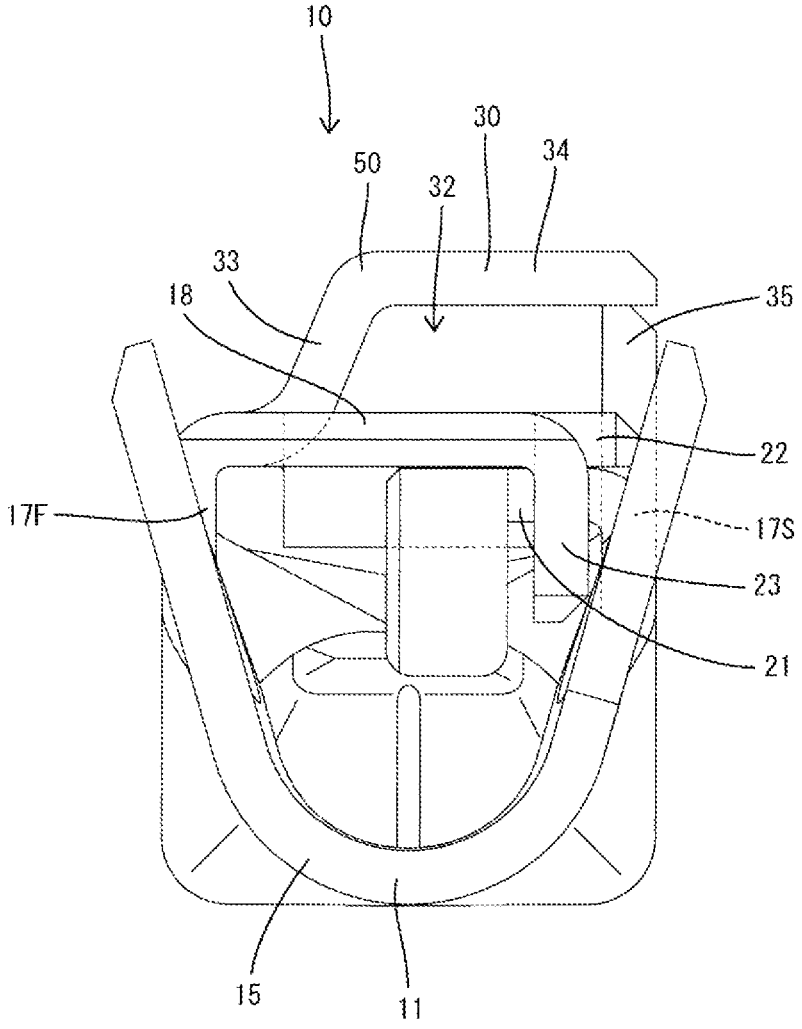
FIG. 11 is a rear view showing a terminal fitting in another embodiment (1).

The projecting wall 36 projects to a height substantially equivalent to the height of the standing wall 35 in the above embodiment. However, as shown in FIG. 11, a projecting wall 50 may project to a height to be placed on the upper end of the standing wall 35. This can prevent crushing deformation of the projection when the terminal fitting passes through the through hole of the seal.

The projection 30 includes the projecting wall 36 adjacent to the standing wall 35 in the width direction WD of the terminal body 12 and open on the side of the standing wall 35 in the above embodiment. However, the entire projection may be integrally or unitarily continuous with the standing wall portion. Specifically, the projection may be formed by being bent in from the upper end of the standing wall.

The invention is applied to the male terminal fitting 10 in the above embodiment, but it can be applied to female terminal fittings in which a contact piece with a mating terminal fitting is provided inside a terminal body.

The projecting wall 36 is formed by striking a part of the ceiling wall 18 in the above embodiment. However, there is no limitation to this and the projecting wall may be formed, for example, by bending the ceiling wall.

The body opening 19 penetrating through the ceiling wall 18 in the thickness direction is formed on the side of the ceiling wall 18 behind the projecting wall 36 in the above embodiment, the body opening may not be provided.

The terminal body 12 includes the inner wall located inside the body opening to close the body opening 19 in the above embodiment. However, the inner wall may not be necessarily provided.

The projection 30 is locked by the locking lance 42 in the above embodiment. However, the rear end of the terminal body may be locked by the locking lance and the locking position of the locking lance can be changed.

REFERENCE SIGNS

10 . . . terminal fitting
11 . . . wire connecting portion
12 . . . terminal body
18 . . . ceiling wall
19 . . . body opening
21 . . . inner wall
30 . . . projection
31 . . . projecting oblique portion (front surface)
35 . . . standing wall 36, 50 . . . projecting wall
40 . . . connector housing
41 . . . cavity
43 . . . body inserting portion
44 . . . projection inserting portion

What is claimed is:

1. A terminal fitting, comprising:

a wire connecting portion configured to be connected to a wire;

a terminal body provided in front of the wire connecting portion and including a tubular box having a bottom wall, first and second opposed side walls projecting up from the bottom wall and a top wall extending from the first side wall toward the second side wall;

a standing wall projecting up from an end of the second side wall opposite the bottom wall and having an upper edge that is inclined to gradually reduce a projecting dimension toward a front end of the terminal fitting, at least a portion of the upper edge of the standing wall being farther from the bottom wall than a distance from a top end of the first side wall to the bottom wall; and a projection defining an upwardly projecting part of the top wall at a position substantially aligned with the standing wall in a front-back direction, the projection being closer to the second side wall than to the first side wall and having a free side edge opposed to the standing wall, a front surface of the projection being inclined to gradually reduce a projecting dimension toward the front and a rear surface of the projection being at least partly open in the front-back direction;

wherein the projection includes a projecting wall, the free side edge defining an edge of the projecting wall and being substantially adjacent to the standing wall in a width direction of the terminal body and projects up to a height of the upper edge of the standing wall.

2. The terminal fitting of claim 1, further comprising an opening penetrating through the top wall of the terminal body in a wall thickness direction and being formed at a position on the side wall behind the projecting wall.

3. The terminal fitting of claim 2, further comprising an inner wall bent inward from the second side wall and at least partly covering the opening.

4. The terminal fitting of claim 1, wherein a width of the projection is larger than substantially half a width of the terminal body.

5. The terminal fitting of claim 1, wherein the projection has a projecting side portion substantially facing the standing wall and being oblique to gradually narrow a width of the projection from a lower end toward an upper end.

6. The terminal fitting of claim 1, wherein the projection extends from a position on the top wall spaced from the first side wall to the standing wall.

7. The terminal fitting of claim 1, wherein an inclination of the projecting wall substantially conforms to an inclination of the upper edge of the standing wall.

8. The terminal fitting of claim 7, wherein the standing wall is substantially coplanar with the second side wall.

9. The terminal fitting of claim 1, wherein the standing wall is substantially coplanar with the second side wall.

10. A connector comprising a connector housing having at least one cavity in which the terminal fitting of claim 1 is inserted.

11. The connector of claim 10, wherein the cavity includes a body inserting portion having a cross-section substantially in conformity with an outer shape of the terminal body and a projection inserting portion having a cross-section substantially in conformity with an outer shape of the projection.

* * * * *